United States Patent [19]

Klitzky

[11] 4,029,024

[45] June 14, 1977

[54] WORK BENCH STRUCTURE

[76] Inventor: David Klitzky, 5107 N. Francisco, Chicago, Ill. 60625

[22] Filed: Apr. 16, 1976

[21] Appl. No.: 677,704

[52] U.S. Cl. ..... 108/60; 35/60; 108/42

[51] Int. Cl.[2] ..... A47B 57/00

[58] Field of Search ..... 35/60; 52/33; 108/42, 108/60; 109/10, 19; 186/1 R, 1 B, ; 232/43.1; 312/140.1, 211, 286

[56] References Cited

UNITED STATES PATENTS

| | | | |
|---|---|---|---|
| 1,436,315 | 11/1922 | Huntress | 109/19 |
| 2,289,861 | 7/1942 | Backus | 52/33 |

*Primary Examiner*—James C. Mitchell
*Attorney, Agent, or Firm*—Alter and Weiss

[57] ABSTRACT

A work bench structure has a horizontal work surface at which articles may be assembled at individual work stations. At the rear of the work surface is a first vertical wall member upon which is mounted a horizontally extending shelf. A second vertical wall member is mounted forward of said first vertical wall member, with the lower edge of said second vertical wall member terminating at a point which is above the shelf yet below the upper edge of the first vertical wall member, thus blocking any direct line of sight extending from the front of the work bench past the second vertical wall member. In this manner, access from the rear of the structure is provided whereby material to be used in the construction of such articles may be placed on the shelf from behind the bench for use by a person standing at the bench. The work bench structure may be arranged to set off a central supply area in which materials for construction of the articles may be stored and cut to size by personnel who cannot be seen by persons using the work bench structure.

10 Claims, 5 Drawing Figures

WORK BENCH STRUCTURE

This application related generally to work benches, and more particularly to a work bench structure at which individual work stations may be provided for assembly of craft articles. Structure is provided whereby material to be used in the construction of such articles may be delivered directly to each such work station from a centrally located materials storage and preparation section, not visible to the work bench user.

Manufacture of handicraft items requires specialized tools, construction techniques and materials, the lack of which has heretofore discouraged those potentially interested in handicrafts from small art and construction projects. Recognizing the inconvenience and expense of acquiring such tools and such materials, merchants now provide commercially available shop facilities where, along with purchasing the materials to be used in the project, the customer may also have use of the specialized tools required, and where shop personnel trained in the construction techniques necessary are available to offer suggestions and advice.

One such establishment recently gaining popularity is the assemble-it-yourself custom framing shop, to which a customer may bring an article to be framed, then select the style and color of frame material, the color of matte board and the type of glass to be used in assemblying a complete frame. Shop personnel assist the customer in making such selections and then determine for the customer the dimensions of the material necessary to construct the frame. Such material is then taken from the store's stock and cut to size.

The customer may then take the material to a work area at which work bench facilities, tools and construction materials, such as staples, nails and glue, are furnished. The customer then stands at the work bench and proceeds to construct the frame and mount the article therein. If the customer is not familiar with the construction techniques necessary, or is less than adept with hand tools, shop personnel are available to offer assistance and advice.

One area of concern for operators of such shops is that store layout and dimensions often dictate that material storage areas and material preparation areas must be located at some distance from the work bench areas. This results in an extremely inconvenient and inefficient materials preparation and delivery format, since a shop employee may be forced to go to one part of the store to collect materials, a second part of the store to cut the materials to size, and a third part of the store to deliver the materials to the customer for eventual frame construction. Another problem experienced is that shop personnel whose duties include the preparation of frame materials for individual customers are often intercepted and detained by other customers requiring help or assistance. Such employees are thus diverted from their primary duites; and, as a result some customers are served at the expense of others. The need, therefore, exists for a work bench structure which makes possible centrally located materials, storage and preparation areas in close proximity to work bench areas, whereby shop employees whose duties include cutting and preparing the frame materials, may work uninterruptedly and most efficiently.

This invention has, therefore, the following objects:

To provide work bench structures adapted for quick and efficient delivery of work materials to individual work stations;

To provide such structures in forms adaptable to define a central materials storage and preparation area;

To provide such structures in forms which make such work stations accessible to personnel working in said storage and preparation area while, at the same time, limiting access to such storage and preparation areas whereby material may be prepared most efficiently by shop employees; and To provide such structures in forms which facilitate efficient utilization of the work surface.

To provide centralized materials, storage and preparation areas to which deliveries of new stocks of materials may be made without disrupting the commercial operating routine of the shop.

These and further objects will become more apparent upon consideration of the accompanying drawings, in which.

Figure 1:
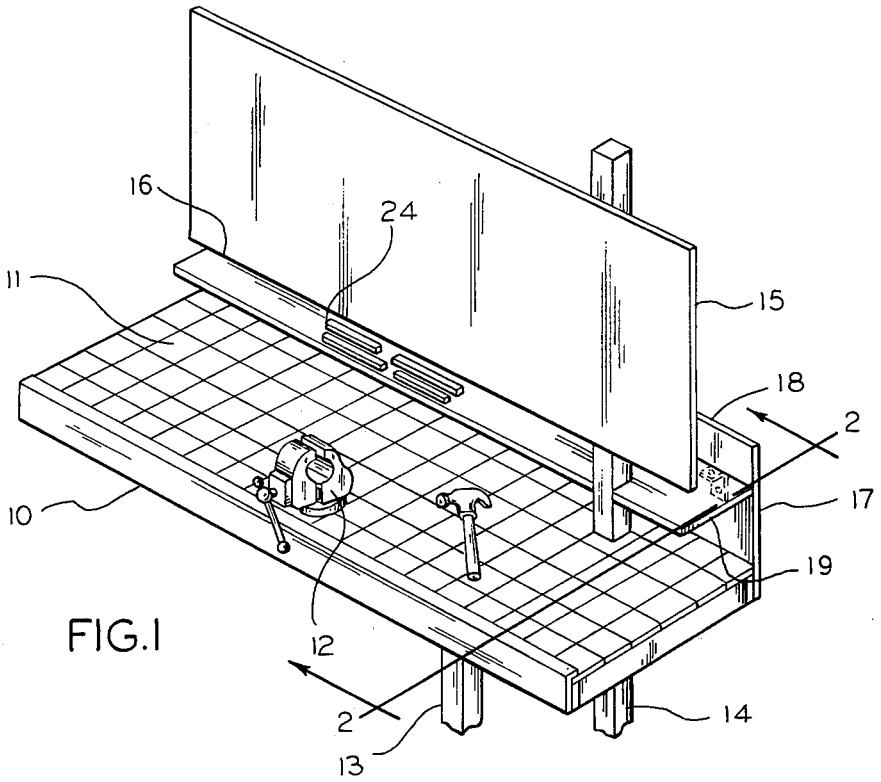
FIG. 1 is a perspective view of the work bench structure.
Figure 2:
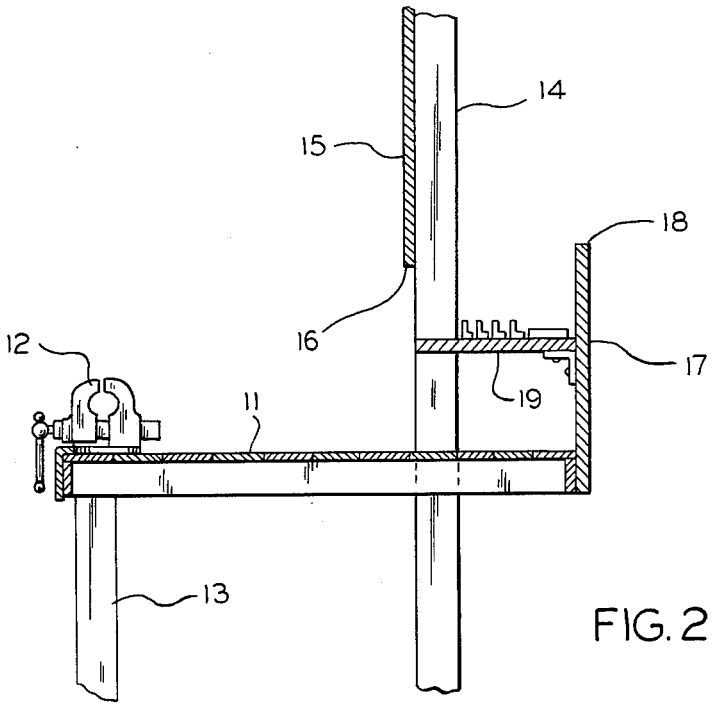
FIG. 2 is a sectional view along 2—2 of FIG. 1.

Consistent with the foregoing objects, application provides a work bench structure 10 having a substantially horizontal work surface 11 having a first partition 15, the lower edge 16 of which is positioned above work surface 11, and second partition 17 positioned rearward of said first partition, having an upper edge 18 which extends above work surface 11 to a point slightly above lower edge 16. A shelf 19 may be provided attached to the rear partition 17 intermediate work surface 11 and lower edge 16. Access to said work surface or said shelf may be had between first partition 15 and second partition 17, and no direct line of sight is possible past partitions 15 and 17 across work surface 11.

Referring now to FIG. 1, the numeral 10 indicated generally a work bench structure having horizontal work surface 11 on which may be mounted vise or clamp 12. Bench 10 is supported by legs, such as that illustrated at 13, and uprights, such as that illustrated at 14. To assure adequate support, uprights 14 may be secured both to the floor and ceiling during installation.

Front partition 15 is attached to uprights 14 in any conventional manner at a height at which lower edge 16 of partition 15 is positioned above work surface 11. Rear partition 17 is fastened to the rearmost edge of work surface 11 and extends upward to a point at which upper edge 18 of rear partition 17 is positioned farther above work surface 11 than is lower edge 16 of front partition 15. Shelf 19 is then conveniently positioned at a point intermediate work surface 11 and lower edge 16.

Figure 5:
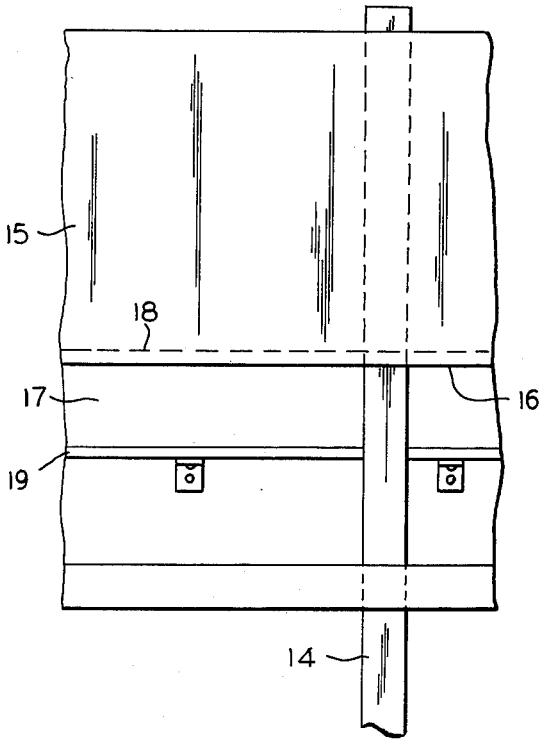
FIG. 5 is a front view of the work station illustrated in FIG. 4.

As illustated in FIG. 5, the dimensions and positioning of front and rear partitions 15 and 17, respectively, preclude any direct line of sight from the front edge of work surface 11 past partition 17. This allows shop personnel working to the rear of the bench 10 to go unobserved by customers working at bench 10.

Figure 4:
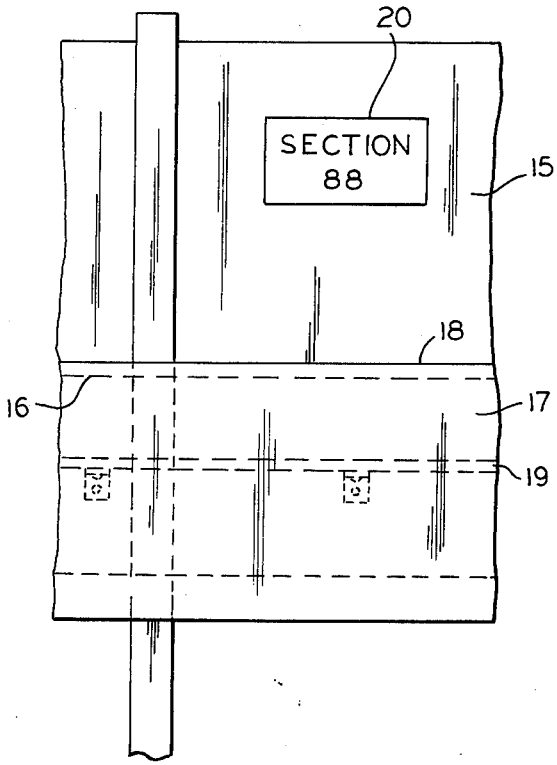
FIG. 4 is a back view of a single work station.

Once the stock material for an individual project has been cut to size, the shop personnel may deliver the material directly to the work station assigned to the customer and may place the material on shelf 19 by reaching over rear partition 17 without being observed by the customer. As illustrated in FIG. 4, work station location 20 may be indicated on the rear of front partition 15, also unobserved by the customer.

Figure 3:
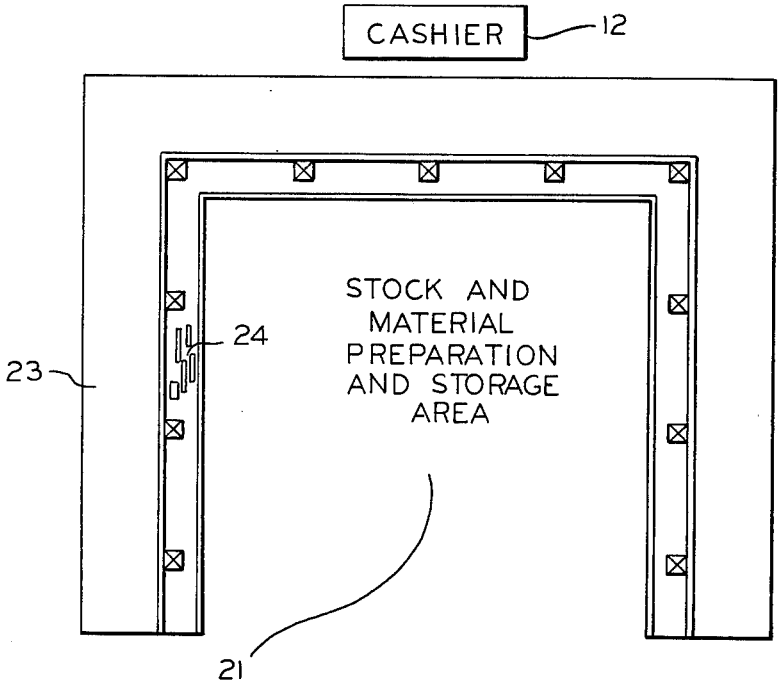
FIG. 3 is a top plan view of a contemplated work bench structure.

A preferred construction of work bench 10 is illustrated in FIG. 3 as a continuous work surface arranged in generally a U-shape. The stock and material preparation and storage area 21, thus defined, allows restocking, storage and cutting of materials and delivery of individual project materials to individual work stations. A similar area may also be set off using a straight length of work bench structure 10 placed diagonally in a shop to isolate a corner of the shop.

Similarly, the geometry of the work bench arrangement may be altered to fit any particular interior shop configuration. Since operation of such a shop requires the use and storage of dangerous and fragile materials, such as glass, and power tools with which frame material may be sawn and mitered, the separation of the material preparation area form the general customer area represents an important safety feature in the operation of the shop.

In a shop using work bench structure 10, a customer entering the shop will select the type of frame material, matte board and glass with which his frame is to be constructed, in the front area of the store, and a work order will be drawn up detailing the materials chosen and the dimensions to which it is to be cut, and indicating the work station to which the customer will be taken.

The customer will then pay for the materials at the cashier 22, as illustrated in FIG. 3, and will then be shown to the work station 23. Materials needed for the customer's frame are then cut and prepared by shop personnel in the stock and material preparation and storage area 21, in accordance with the work order. When th materials 24 are prepared, they are placed on shelf 19 at work station 23, and the customer is then prepared to proceed to construct the frame. If, during construction, the customer needs assistance, shop personnel assigned to the outer portion of the shop will be available to furnish advice while shop personnel working in stock area 21 are free to continue preparation of materials for other orders without interruption. In this manner, preparation of materials and delivery to individual work stations is maximized. Additionally, customers are precluded from entering any area within which glass cutters, sharp knives, power tools or the like are being used. The front partitions 15 may also provide convenient mounting surfaces for directions for construction, examples of various types of frames and mountings, or other graphic material.

If construction of the work bench structures illustrated at FIG. 3 is positioned to allow direct access from a rear door to the shop premises, incoming deliveries of stock and materials may be made without interrupting the commerical operation of the shop — again, without having been seen by shop customers. Thus fashioned, work bench structure 10 provides a simple, strudy, economical and practical means for cutting and distributing construction materials, while maintaining an optimum customer traffic flow pattern.

While the foregoing has presented a specific embodiment, it is to be understood that this embodiment is by way of example only, and is not intended to limit the scope of the invention. It is to be expected that others skilled in the art will perceive variations which, while differing from th foregoing example, do not depart from the spirit and scope of the invention described herein.

I claim:

1. A workbench structure comprising:
a substantially horizontal continuous work surface;
support means extending through and supporting said work surface;
first partition means fixedly attached to said support means;
said first partition means having a lower edge,
said first partition means being positioned above said work surface a sufficient distance so as to allow the passage of handicraft items beneath said lower edge to and from said work surface;
second partition means attached to said work surface,
said second partition means having an upper edge extending above said lower edge of said first partition means, so as to prevent vision past said first and second partition means,
said first and second partition means being spaced a sufficient distance apart horizontally so as to allow continuous access over said second partition means and beneath said first partition means to said work surface.

2. The apparatus as recited in claim 1 wherein:
said first partition means and said second partition means are substantially vertical.

3. The apparatus as recited in claim 1 wherein said second partition means includes shelf means,
said shelf means being attached to said second partition means at a point intermediate said work surface and said lower edge.

4. A workbench structure comprising:
substantially horizontal, rectangular segments having front and rear edges,
said segments arranged to define a continuous work surface;
support means extending through said work surface;
first partition means fixedly attached to said support means,
said first partition means having a lower edge,
said lower edge being positioned intermediate said front and read edges, and above said work surface a sufficient distance so as to allow the passage of handicraft items beneath said lower edge to and from said work surface;
second partition means,
said second partition means attached to said work surface at said rear edges,
said second partition means having an upper edge extending vertically above said lower edge of said first partition means, so as to prevent vision past said first and second partition means,
said first and second partition means being spaced a sufficient distance apart horizontally so as to allow coninuous access over said second partition means and beneath said first partition means to said work surface.

5. The apparatus as recited in claim 4 including shelf means,
said shelf means being positioned intermediate said lower edge and said work surface, and
said shelf means being substantially horizontal.

6. The apparatus as recited in claim 4 wherein said work surface segments are arranged in a continuous geometric figuration, said first partition means and said second partition means, respectively, being contiguous for the length of said configuration, and said first partition means and said second partition means in said configuration defining thereby a central area whereby substantially continuous access may be had between said first and second partition means from said area to said work surface segments.

7. The apparatus as recited in claim 6 wherein said configuration is in the shape of a U having an inner and outer perimeter, said second partition means being aligned along said inner perimeter.

8. The apparatus as recited in claim 6 wherein said work surface is characterized by individual work stations.

9. A work bench structure for a room having a floor and a ceiling, said work bench structure comprising:

a substantially horizontal work surface having front and rear edges;

first support means, said first support means extending from said work surface to said floor;

second support means, said second support means extending from said floor to a point proximate said rear edges, thence to said ceiling;

first partition means, said first partition means having a lower edge, said first partition means being mounted on said second support means whereby said lower edge is positioned above said work surface; and second partition means, said second partition means having an upper edge, said second partition means being fastened to said work surface at said rear edge, said second partition means being thereby positioned rearward of said first partition means, said second partition means extending above said work surface to a height sufficient to position said upper edge of said second partition means slightly above said lower edge of said first partition means whereby no direct line of sight is possible across said work surface past said rear edge and access to said work surface may be had between said first and second partition means.

10. The apparatus as recited in claim 9 wherein said work surface segments are characterized by individual work stations.

* * * * *